US006499200B1

(12) United States Patent
Yamagishi et al.

(10) Patent No.: US 6,499,200 B1
(45) Date of Patent: Dec. 31, 2002

(54) SLIDER FOR A SLIDE FASTENER

(75) Inventors: Koji Yamagishi, Toyama-ken (JP); Hideyuki Matsushima, Toyama-ken (JP); Hisashi Yoneshima, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/695,837

(22) Filed: Oct. 26, 2000

(30) Foreign Application Priority Data

Oct. 29, 1999 (JP) ..... 11-308914

(51) Int. Cl.[7] ..... A44B 19/26; A44B 19/28

(52) U.S. Cl. ..... 24/429; 24/415; 24/418; 24/421

(58) Field of Search ..... 24/415–431

(56) References Cited

U.S. PATENT DOCUMENTS

| | | | | | |
|---|---|---|---|---|---|
| 2,316,133 | A | * | 4/1943 | Schaaff | 24/429 |
| 2,524,574 | A | * | 10/1950 | Ryser | 24/421 |
| 2,694,243 | A | * | 11/1954 | Ulrich | 24/424 |
| 2,784,474 | A | * | 3/1957 | Morin | 24/424 |
| 4,069,556 | A | * | 1/1978 | Takahashi | 24/421 |
| 4,455,879 | A | * | 6/1984 | Hakoi et al. | 73/862.01 |
| 4,976,015 | A | * | 12/1990 | Ishii | 24/429 |
| 4,982,479 | A | * | 1/1991 | Oda | 24/424 |
| 5,101,538 | A | * | 4/1992 | Dieter | 24/429 |
| 5,105,512 | A | * | 4/1992 | Aussedat | 24/429 |
| 5,729,874 | A | * | 3/1998 | Mizuno | 24/429 |
| 5,884,373 | A | * | 3/1999 | Kawamura | 24/421 |
| 5,956,819 | A | * | 9/1999 | Terasaki et al. | 24/419 X |
| 6,237,199 | B1 | * | 5/2001 | Wang | 24/429 |

FOREIGN PATENT DOCUMENTS

| | | | | |
|---|---|---|---|---|
| EP | 0 291 816 | A1 | * | 11/1988 |
| JP | 02001095607 | A | * | 4/2001 |

* cited by examiner

*Primary Examiner*—J. J. Swann
*Assistant Examiner*—Ruth C. Rodriguez
(74) *Attorney, Agent, or Firm*—Finnegan, Henderson, Farabow, Garrett & Dunner, L.L.P.

(57) ABSTRACT

The present invention intends to provide a zipper pull of a slider for slide fastener formed of- resilient body on which no unreasonable force is applied when the fastener is opened or closed and which is always kept in a stabilized condition that it is urged to be fallen onto a slider body without swinging freely. A yoke which is a zipper pull mounting portion is mounted on a top face of a slider body. A half-annular shaped zipper pull formed of resilient body is fixed to lateral bars at front and rear ends of a rectangular connecting body longer than the slide body. A lateral bar is provided in the center of the connecting body and inserted through an automatic locking pawl lever incorporated in the yoke. Neck portions are provided in the vicinity of a fixing portion at the front and rear ends so that the zipper pull is elastically deformable easily. A grip portion is provided at a position apart from the fixing portion so that the zipper pull is easy to grip. Further, a feature of the zipper pull of this invention is that a central portion to be disposed on the slider body of the connecting body is low while the sides of the fixing portions on both ends are located higher and extended horizontally with a step. Consequently, when the zipper pull is brought up slightly, the locking pawl lever can be raised so that the slider can be slid. The zipper pull is always kept in such a stabilized condition that it is fallen to the slider body.

16 Claims, 14 Drawing Sheets

SLIDER FOR A SLIDE FASTENER

BACKGROUND OF THE INVENTION

1. Field of the Invention

The present invention relates to a zipper pull of a slider for slide fastener for use behind a fly of mainly a front-open cloth such as a training wear and jacket, and more particularly to a zipper pull of a slider for slide fastener, the zipper pull being formed of resilient body and urged so as to be fallen onto a slider body, thereby maintaining a stabilized state in which the zipper pull does not swing freely when the cloth is worn.

2. Description of the Related Art

As shown in FIG. 16, a conventional slider zipper pull 2' is formed of resilient member 37' fixed to a connecting body 3' supported pivotally in the same direction as a sliding direction of the slider body 1'. The resilient member 37' is capable of moving and holding the resilient member 37' itself and the connecting body 3' elastically in the longitudinal direction relative to substantially the same plane as the slider at their locking position. The connecting body 3' comprises a first end portion 3'-1 which is supported pivotally on the slider and a second end portion 3'-2 fixed to the resilient member 37'. The resilient member 37' has a free end portion 27' which is disposed at a position apart from the second end portion 3'-2. The free end portion 27' of the resilient member 37' and the second end portion 3'-2 of the connecting body 3' are located oppositely each other at both ends of the slider at a locking position of the slider. Further, the first end portion 3'-1 of the connecting body 3' is disposed between the second end portion 3'-2 and the free end portion 27' of the resilient member 37'. Such a slider for slid fastener has been disclosed in U.S. Pat. No. 5,101,538.

According to a slider for slide fastener disclosed in U.S. Pat. No. 2,263,393, as shown in FIG. 17, a pin 18" is attached in a longitudinal direction in the center of a top face of a slider body 1" of the slider so that two sheet-like zipper pulls 2" are supported pivotally by this pin 18" so as to be capable of rotating to the left and right. The sheet-like zipper pulls 2" are formed so as to be always fallen onto the slider body 1" by a coil spring 19" inserted through the pin 18". A locking pawl 11" is provided on a proximal portion of the sheet-like zipper pull 2" and when the slider is not moved, the locking pawl 11" is fitted in between fastener elements to prevent the slider from sliding. When it is intended to move the slider, the right and left zipper pulls 2" are raised so as to escape the locking pawl 11" from between the fastener elements. Consequently this slider can be slid.

In case of the zipper pull 2' of a slider for slide fastener shown in FIG. 16, when the slider is slid in the longitudinal direction to close the slide fastener, the ring-like zipper pull 2' of resilient member 37' has to be pulled forward. At that time, the resilient member 37' must be turned substantially at 180° between a free end portion 27' and a second end portion 3'-2 fixed to the connecting body 3' and then pulled forward. On the other hand, to separate and open the slide fastener, the resilient member 37' has to be also turned substantially at 180° between the free end portion 27' and the second end portion 3'-2 fixed to the connecting body 3' and then pulled backward. Therefore, the ring-like resilient member 37' may be damaged because a turning load is applied to the second end portion 3'-2 fixed to the connecting body 3', so that this zipper pull 2' cannot bear a long term use.

In case of the zipper pull 2" of the slider for slide fastener shown in FIG. 17, the zipper pull 2" is metallic, so it is hard and not flexible. Because of it, there is a feeling of discomfort when it is used in a training wear, jacket and the like. Particularly, this zipper pull 2" is not suitable for an opening of cloth which is kept in contact with the skin. Further, because the right and left zipper pulls 2" have to be always raised so as to slide the slider, there is such a problem that an opening/closing operation for this slide fastener is troublesome.

SUMMARY OF THE INVENTION

The present invention has been achieved in views of the above described problems. An object of the invention is to provide a zipper pull of a slider for slide fastener capable of opening or closing the slide fastener when the zipper pull of resilient body mounted to a slider body with a connecting body is rotated with a slight rotation and then pulled in a direction perpendicular to a sliding direction of the slider or in a forward direction. More specifically, the main object is to provide such a zipper pull of a slider for slide fastener, wherein, when the slider is opened or closed, the resilient body does not have to be twisted so much, so that the zipper pull is protected from a damage and capable of bearing a long term use and also kept pressured in a contact with the slider body in a stabilized condition without swinging, thereby providing a user with no discomfort.

Another object of the invention is to provide a zipper pull of resilient body suitable for various types of the sliders by specifying a configuration of the zipper pull formed of resilient body to be mounted on the slider body, for example, to a shape of half-annulus, annulus, strip, sheet or the like.

And another object of the invention is to provide various kinds of zipper pulls of resilient body formed on the slider body easy to grip and handle when the slider is slid.

Also another object of the invention is to provide a connecting body for the zipper pull capable of holding the zipper pull of resilient body on the slider body in a stabilized condition with a good appearance by specifying the shape of the connecting body used for mounting the zipper pull onto the slider body and forming the shape of the connecting body to a shape which facilitates the handling thereof and further is capable of fixing the zipper pull of resilient body firmly.

And a further object of the invention is to provide a slider with an automatic locking mechanism having the zipper pull of resilient body and being produced easily by specifying the shape of the connecting body to adapt the zipper pull of resilient body to a slider having various types of the automatic locking mechanisms.

It is also another object of the invention to provide a zipper pull of resilient body which can be produced easily by specifying material of various types of zipper pulls of resilient body.

To achieve the above object, according to the main aspect of the invention, there is provided a zipper pull of a slider for slide fastener, wherein an mounting portion for mounting a zipper pull is provided on a top face of a slider body of a slider; an annular connecting body having an appropriate shape is disposed to the mounting portion; a lateral bar is provided in the center of the connecting body; the lateral bar is mounted on the mounting portion such that it is inserted therethrough; the zipper pull formed of resilient body is fixed to front and rear ends or only a front end of the connecting body so as to form fixing portions; and the zipper pull formed of resilient body is always urged to be fallen on a surface of the slider body, that is, a top face or side face of the slider body. Particularly if the connecting body is used in a slider with an automatic locking mechanism, the locking mechanism can be operated by tilting the connecting body slightly in the longitudinal direction or in the width direction. The condition mentioned here that the zipper pull is fallen onto the surface of the slider body means that the zipper pull is disposed substantially parallel to a top face or side face of the slider body.

Preferably, the zipper pull formed of resilient body is formed entirely in a substantially half-annular shape while end portions thereof are fixed horizontally to the lateral bars provided at front and rear ends of the connecting body attached to the mounting portion on the slider body so as to form fixing portions. The half annular zipper pull mentioned here includes not only a semi-circular ring shape but also a C letter shape, an ear shape and the like.

Alternatively, the zipper pull formed of resilient body is formed entirely in a substantially annular shape; mounting tongues for mounting the connecting body are provided at portions opposing each other of the annular zipper pull so that it protrudes in an inner edge of the zipper pull; and the mounting tongues are fixed horizontally to the lateral bars provided at the front and rear ends of the connecting body mounted to the mounting portion on the slider body so as to form the fixing portions. The substantially annular zipper pull mentioned here includes not only the annular shape but also heart shape and the like.

Alternatively, the zipper pull formed of resilient body is formed entirely in a strip shape; a transparent hole, that is, a through hole is formed by cutting out a central portion of the strip shaped zipper pull so that the mounting portion provided on the slider body appears; and an end of the zipper pull is fixed to the lateral bar provided at the front end of the connecting body mounted to the mounting portion on the slider body so as to form the fixing portion while the other end of the zipper pull is kept free.

Still alternatively, the zipper pull formed of resilient body is formed entirely in a sheet-like shape; an end of the sheet-like zipper pull is fixed to the lateral bar provided at the front end of the connecting body mounted to the mounting portion on the slider body so as to form the fixing portion; and the zipper pull is extended so as to cover a top face of the mounting portion on the slider body from a top end of the fixing portion.

Preferably, a constricted or concave neck portion is formed in the vicinity of the fixing portion in which the zipper pull formed of resilient body is fixed to the connecting body mounted to the mounting portion on the slider body so as to provide flexibility to the zipper pull.

And preferably, the zipper pull formed of resilient body includes a grip portion such that a space is expanded obliquely forward with respect to the fixing portion in which the zipper pull is fixed to the connecting body mounted to the mounting portion on the slider body so as to be gripped easily.

Also preferably, the zipper pull formed of resilient body includes a grip portion having an expanded diameter or a large thickness provided at a portion apart from the fixing portion in which the zipper pull is fixed to the connecting body mounted to the mounting portion on the slider body so as to be gripped easily.

Further preferably, the connecting body for fixing the zipper pull formed of resilient body is formed in a rectangular or elongated circle annular frame body longer than the mounting portion and the connecting body is disposed in a longitudinal direction, that is, in a sliding direction with respect to the mounting portion formed on a top face of the slider body.

Preferably, the connecting body for fixing the zipper pull formed of resilient body includes the lateral bars on the edge portions thereof such that a central portion of the frame body disposed in a longitudinal direction, that is, in a sliding direction on a top face of the slider body, is low while the front and rear ends thereof are located higher and extend horizontally with a step.

Also preferably, a flat mounting piece extended inward or outward is provided on each of the lateral bars of the connecting body of the fixing portions for fixing the zipper pull formed of resilient body such that it protrudes from the lateral bar and the mounting piece is buried in the zipper pull of resilient body.

Preferably, the lateral bar disposed laterally in the center of the connecting body, to which the zipper pull formed of resilient body is fixed, is inserted through an automatic locking pawl lever incorporated in a yoke for mounting the zipper pull mounted on a top face of the slider body such that the automatic locking pawl lever is capable of being raised by lifting up or pulling up the zipper pull.

And also preferably, two lateral bars are disposed with an interval in the center of the connecting body to which the zipper pull formed of resilient body is fixed and one of the lateral bars is inserted through the automatic locking pawl lever incorporated in the yoke for mounting the zipper pull mounted on a top face of the slider body while the other one is inserted through a sliding body capable of sliding within the yoke for mounting the zipper pull such that the automatic locking pawl lever is capable of being raised by lifting up or pulling up the zipper pull.

Preferably, the connecting body to which the zipper pull of resilient body is fixed includes a lateral bar provided laterally in the center thereof; the lateral bar is fitted freely and movably with a sliding groove for guiding provided laterally on a bottom end of each of both side walls of the yoke mounted on a top face of the slider body; the yoke incorporates an automatic locking pawl lever having a sheet-like spring piece protruded on a top portion thereof, a locking pawl provided on a bottom end, a protruded portion capable of being fitted freely detachably with a cut-out portion in the slider body on the other bottom end and a cam face provided between the locking pawl and the protruded portion; and the lateral bar is kept in contact with the cam face so that the automatic locking pawl lever is capable of being raised by lifting up or pulling up the zipper pull.

And preferably, the zipper pull formed of resilient body is molded integrally by using natural rubber, synthetic rubber or thermoplastic elastomer so as to provide flexibility to the zipper pull.

DESCRIPTION OF THE PROFFERED EMBODIMENTS

Figure 1:
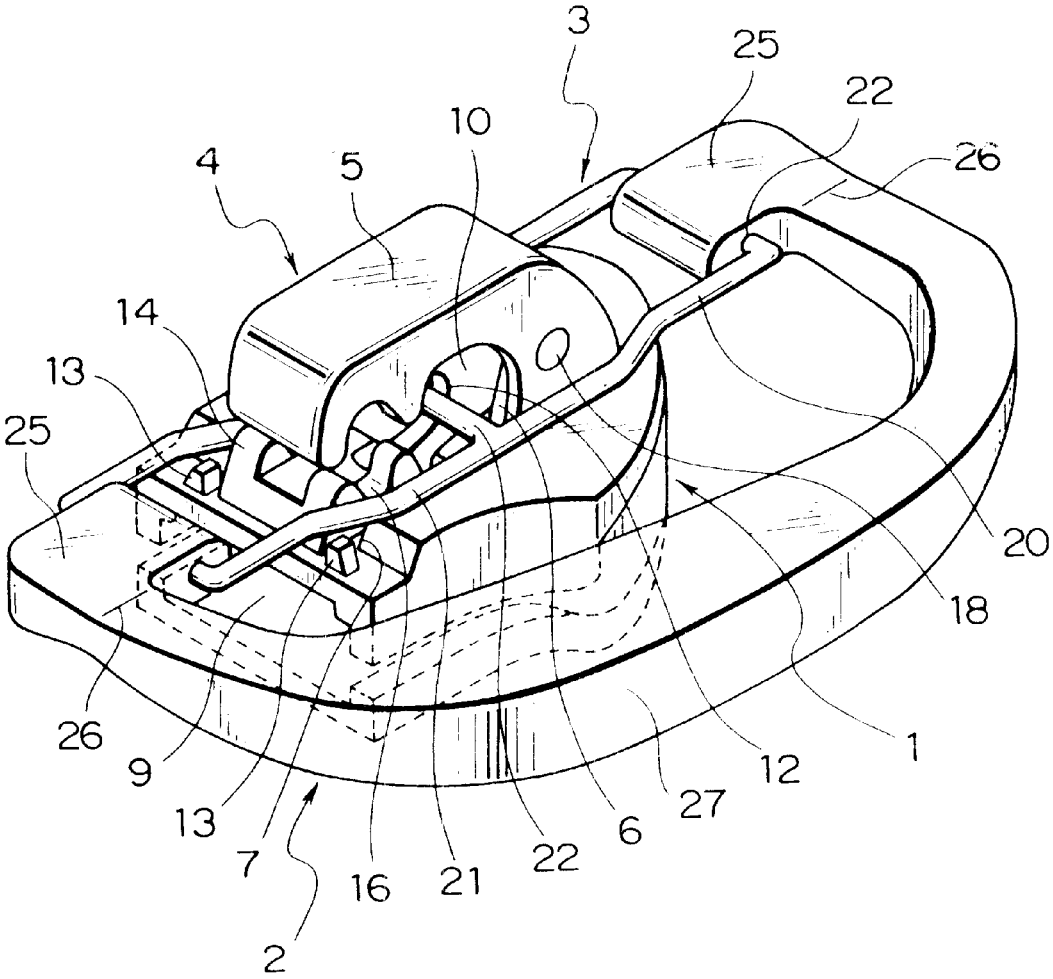
FIG. 1 is a perspective view of a slider having a zipper pull of a slider for slide fastener of a first embodiment of the present invention.
Figure 2:
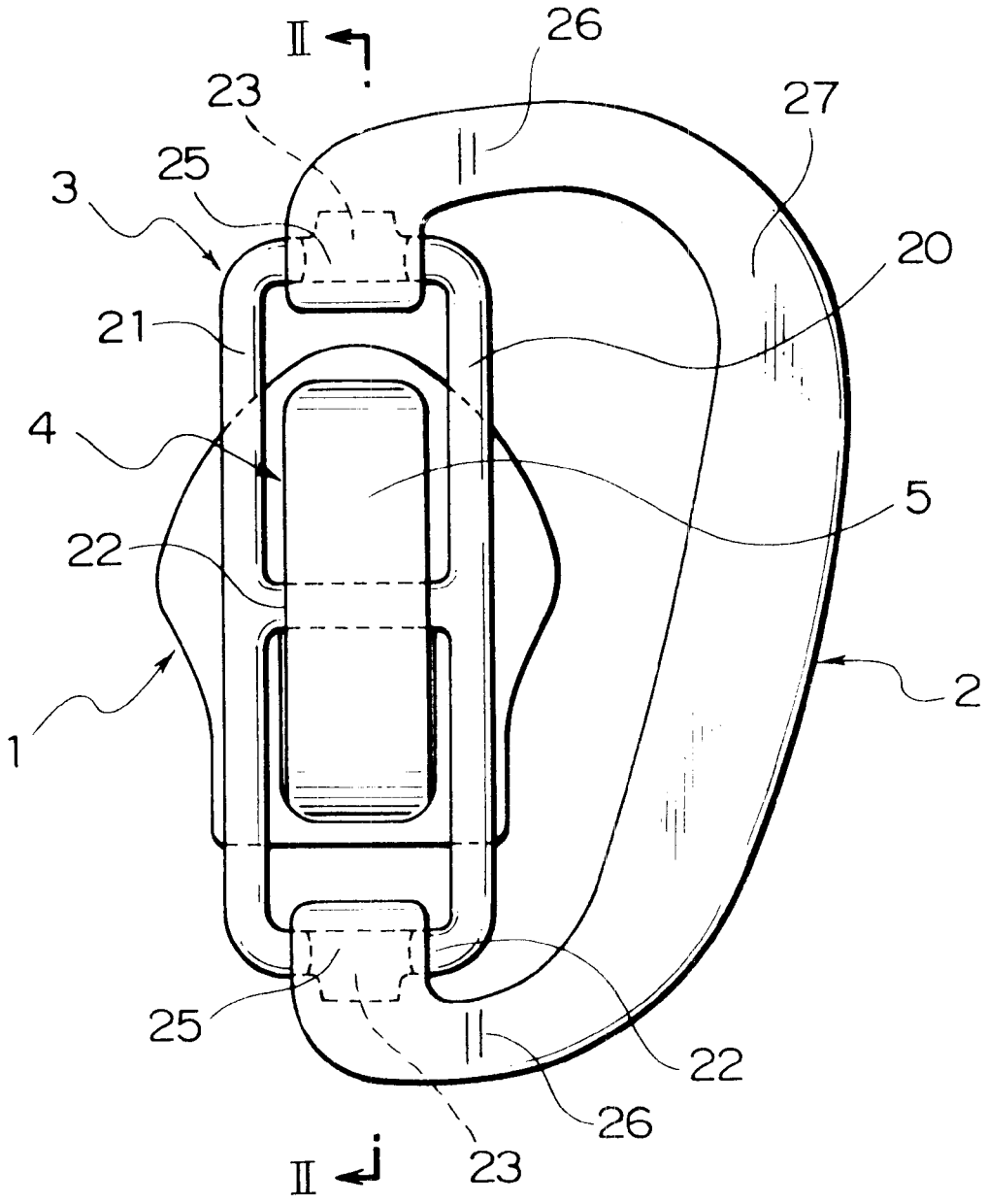
FIG. 2 is a plan view of the slider of FIG. 1.

Hereinafter, the preferred embodiments of a zipper pull of a slider for slide fastener of the invention will be described in detail with reference to the accompanying drawings.

If a common structure to respective embodiments of the zipper pull of a slider for slide fastener of the invention is described, a zipper pull 2 formed of resilient body is mounted to a zipper pull mounting portion 4 provided in a longitudinal direction in the center of a top face of a slider body 1 with an annular connecting body 3 having an appropriate shape. The connecting body 3 is mounted so as to move slightly rotatably or slidably in a longitudinal direction along the mounting portion 4 or a lateral direction which is perpendicular thereto. The zipper pull 2 formed of resilient body and having an appropriate shape is fixed on front and rear ends or a front end of this connecting body 3 and always urged so as to be fallen onto a surface of the slider body 1, that is, a top face and a side face of the slider body 1 so that the zipper pull 2 is prevented from swinging freely.

The zipper pull of a slider for slide fastener of a first embodiment shown in FIGS. 1 to 4 is installed on a slider provided with an automatic locking device. A yoke 5 which is the zipper pull mounting portion 4 is installed in a longitudinal direction in the center of a top face of the slider body 1. The yoke 5 is supported pivotally on an mounting post 6 provided in a front portion of the slider body 1 with a supporting shaft 18. A locking pawl lever 10 having a locking pawl 11 protruding downward from a rear end thereof is pivoted with this supporting shaft 18 within the yoke 5. The locking pawl lever 10 laterally has a concave portion 12 above the locking pawl 11, and a coil spring 19 disposed in the slider body 1 is in an elastic contact with a front end of the locking pawl lever 10, so that the locking pawl 11 is always protruded through a pawl hole 8 into a guide groove 9 for guiding fastener elements.

The connecting body 3 is formed of a rectangular annular frame body 20 which is wider than the yoke 5 as the zipper pull mounting portion 4 and longer in the longitudinal direction than the slider body 1. The frame body 20 can be mounted on the slider body 1 and is comprised of vertical bars 21 on both sides of the frame body 20 and lateral bars 22 on front and rear ends thereof while one single lateral bar 22 is disposed in the center of the frame body 20, thereby forming the connecting body 3. This lateral bar 22 is installed on the yoke 5 such that the lateral bar 22 disposed in the center of the frame body 20 is inserted through a concave portion 12 formed in the locking pawl lever 10 provided within the yoke 5 and then, by operating the zipper pull 2 mounted on the yoke 5, the connecting body 3 tilts forward, backward or to the right or left. This tilting is very slight in any direction, so that the lateral bar 22 in the center of the frame body 20 swings in a range where the locking pawl lever 11 is movable within the yoke 5. The frame body 20 of the connecting body 3 is bent with a step so that its central portion is low to be in contact with a top face of the slider body 1 and both end portions thereof are higher and extended horizontally. Therefore, the frame body 20 is kept in contact with the slider body 1 so that the frame body 20 cannot tilt extremely. Then, the frame body 20 of the connecting body 3 may be molded by die-casting with aluminum alloy, zinc alloy or the like. Meanwhile, the shape of the connecting body 3 may be not only rectangular but also elongated annular or other appropriate shape. Further, the size of the connecting body 3 does not always have to be longer than the slider body 1 and in case of a large slider, the connecting body 3 may be shorter than the slider body 1.

The zipper pull 2 is formed of resilient body and integrally molded of such resilient body as raw rubber, synthetic rubber and thermoplastic elastomer. Upon molding, the lateral bars 22 on front and rear ends of the frame body 20 of the connecting body 3 are buried in the resilient body so as to fix the zipper pull 2 to the connecting body 3 firmly to form fixing portions 25. To form fixing portions 25 such firmly, tongue like mounting pieces 23 extending outward are provided by pressing a part of each of the lateral bars 22 on the front and rear ends and buried in the resilient body. The zipper pull 2 is formed in ear-like semi-annular shape, and the zipper pull 2 is provided with a constricted portion in diameter or a concave neck portion 26, in the vicinity of the fixing portion 25 in which the lateral bars 22 on the front and rear ends of the frame body 20 are fixed, thereby making a flexible motion of the zipper pull 2. Further, the zipper pull 2 is provided with an expanded portion having an enlarged diameter or a grip portion 27 having a large thickness at a portion far from the both fixing portions 25 so that the zipper pull 2 is easy to grip. Further, the grip portion 27 is provided such that a space is expanded obliquely forward with respect to the fixing portion 25 on the front end so that the zipper pull 2 is easy to grip.

The connecting body 3 integrated with the zipper pull 2 of resilient body is installed onto the slider body 1 as follows. A concave groove 7 like a dovetail groove is provided on a top face of the slider body 1 from a rear opening side of the slider body 1. A sliding body 14 capable of sliding longitudinally is fitted into the concave groove 7. The sliding body 14 has protruded portions which are protruded from both sides of a bottom portion thereof and fits into the concave portion 7 freely slidably. A coil spring is disposed between the sliding body 14 and the mounting post 6 on which the yoke 5 is mounted so that the sliding body 14 is elastically urged toward the rear opening side. Further, a recess 16 formed by two mountains is provided on a top face of the sliding body 14. The lateral bar 22 provided in the center of the frame body 20 is inserted into the concave portion 12 provided in the locking pawl lever 10. A front portion of the yoke 5 is supported pivotally by the mounting post 6 through a supporting shaft 18 and a rear portion of the yoke 5 is formed so as to be open, so that the sliding body 14 can be inserted through the rear opening side of the slider body 1. With the lateral bar 22 provided in the center of the connecting body 3 in contact with an end of the sliding body 14, the sliding body 14 is forced into so as to insert the lateral bar 22 into the concave portion 12 of the locking pawl lever 10. With the lateral bar 22 inserted completely into the concave portion 12, sealing protrusions 13 provided at an entrance of the concave groove 7 are crushed to seal part of the concave groove 7 thereby preventing the sliding body 14 from slipping out of the concave groove 7. Consequently, the frame body 20 of the connecting body 3 is placed on the top face of the slider body 1. And, assembly of the slider with the automatic locking device is completed.

Figure 3:
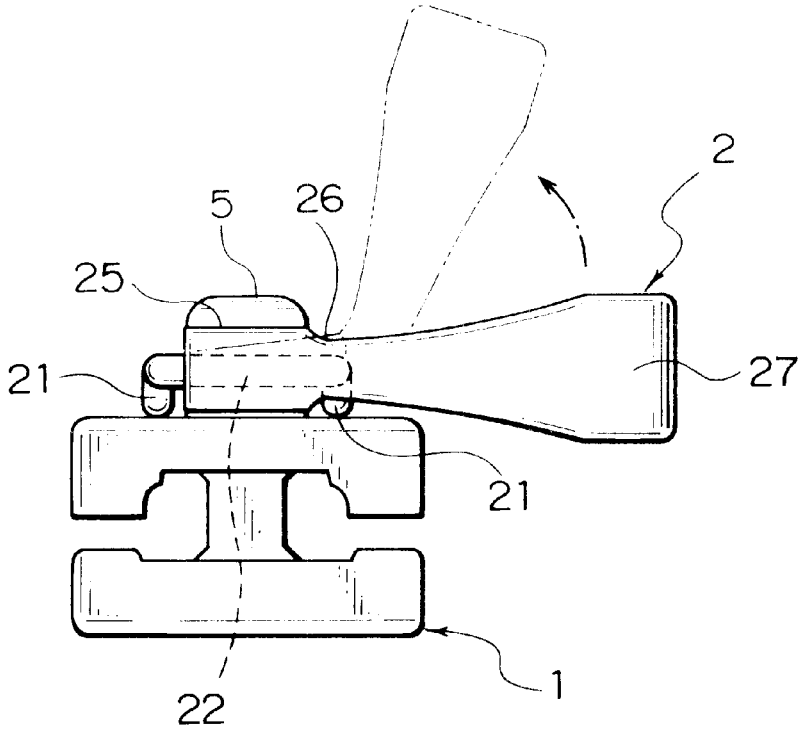
FIG. 3 is a rear view of the slider of FIG. 1.
Figure 4:
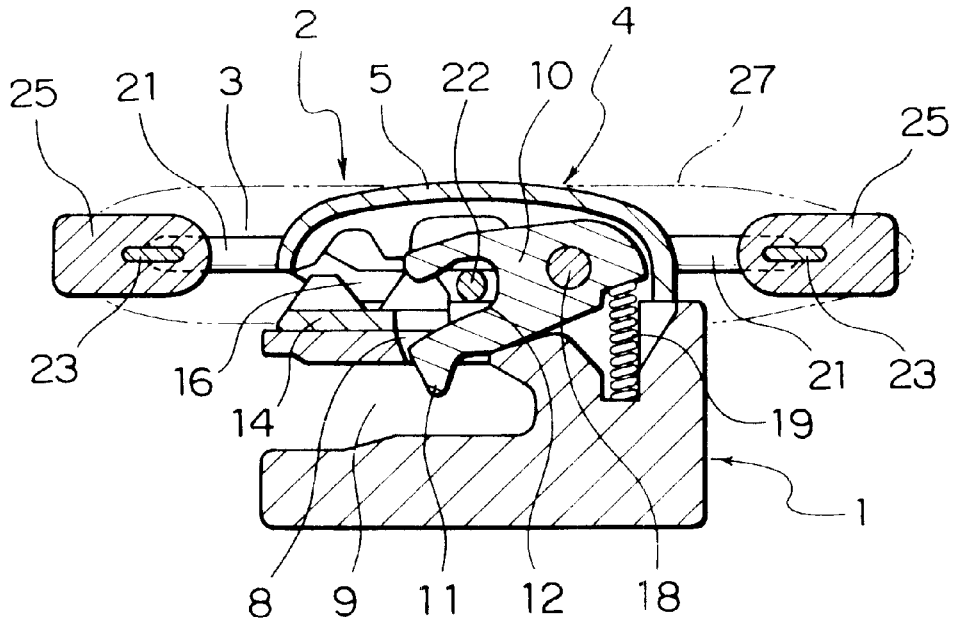
FIG. 4 is a sectional view taken along the line II—II in FIG. 2 of the slider of FIG. 1.

An operation of the slider will be described. When it is intended to close the fastener chain, the finger is inserted into the grip portion 27 of the zipper pull 2. Then when it is pulled forward, the zipper pull 2 of resilient body is raised with the neck portion 26 so that a force for rotating the fixing portion 25 which fixes the resilient body and a force for lifting up the zipper pull 2 act at the same time as shown in FIG. 3. Consequently, the free vertical bars 21 of the connecting body are lifted up slightly from the top face of the slider body 1 and simultaneously the locking pawl lever 10 within the yoke 5 is also lifted up. Then, the locking pawl 11 is escaped from the guide groove 9 so that the slider is capable of sliding forward. Meanwhile, even if the locking pawl 11 is protruded slightly from the guide groove 9, the coil spring 19 is compressed by fastener elements depending on the shape of the locking pawl lever 10, so that the slider can be slid forward.

When the slider is locked and the finger is released from the grip portion 27 of the zipper pull 2, the zipper pull 2 is fallen onto the top face of the slider body 1 by a restorability force of the resilient body. At the same time, the connecting body 3 also comes into contact with the top face of the slider body 1. The locking pawl lever 10 protrudes the locking pawl 11 into the guide groove 9 by an elastic force of the coil spring 19 so that the locking pawl 11 is inserted between the fastener elements thereby automatically locking the slider. The zipper pull 2 is maintained in a state in which it is fallen onto the slider body 1 and in contact therewith, so that the zipper pull 2 is held without swinging freely.

Next, when it is intended to separate and open the fastener chain, the grip portion 27 of the zipper pull 2 is gripped so as to lift up the zipper pull 2 slightly and then, the zipper pull 2 is pulled backward. Then, the zipper pull 2 of resilient body rotates the fixing portion 25 by such a force of lifting up. The connecting body 3 lifts up the free vertical bars 21 slightly from the top face of the slider body 1 by such an action and at the same time, the locking pawl lever 10 is also lifted up. Consequently, the locking pawl 11 is escaped from the guide groove 9 so that the slider can be slid backward.

As described above, when the zipper pull 2 made of half-annular shaped resilient body is lifted up slightly against an elastic force of the resilient body, the slider can be slid. Further, when the fingers are released from the zipper pull 2, the zipper pull 2 is automatically fallen onto the surface of the slider body 1 by an elastic force of the resilient body. As long as no external force is applied to the zipper pull 2, the zipper pull 2 is maintained on the slider body 1 so that it is maintained stably without swinging freely.

Figure 5:
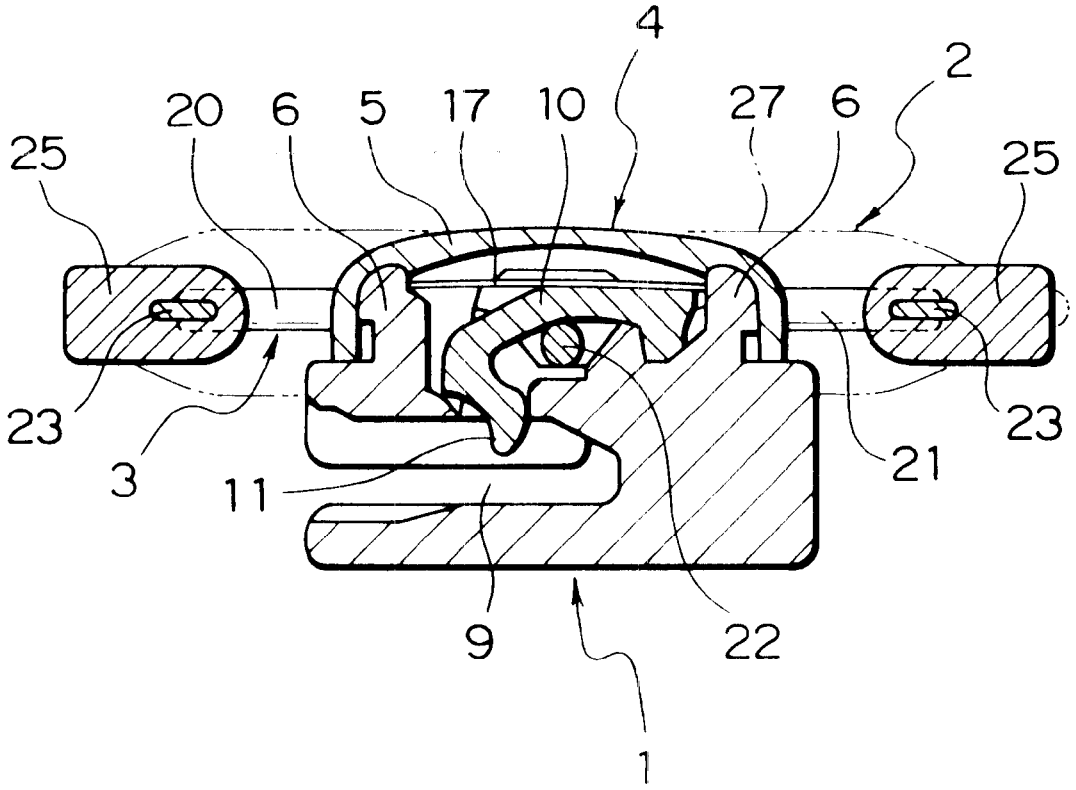
FIG. 5 is a longitudinal sectional view of a slider having a zipper pull of a slider for slide fastener according to a second embodiment of the invention.
Figure 6:
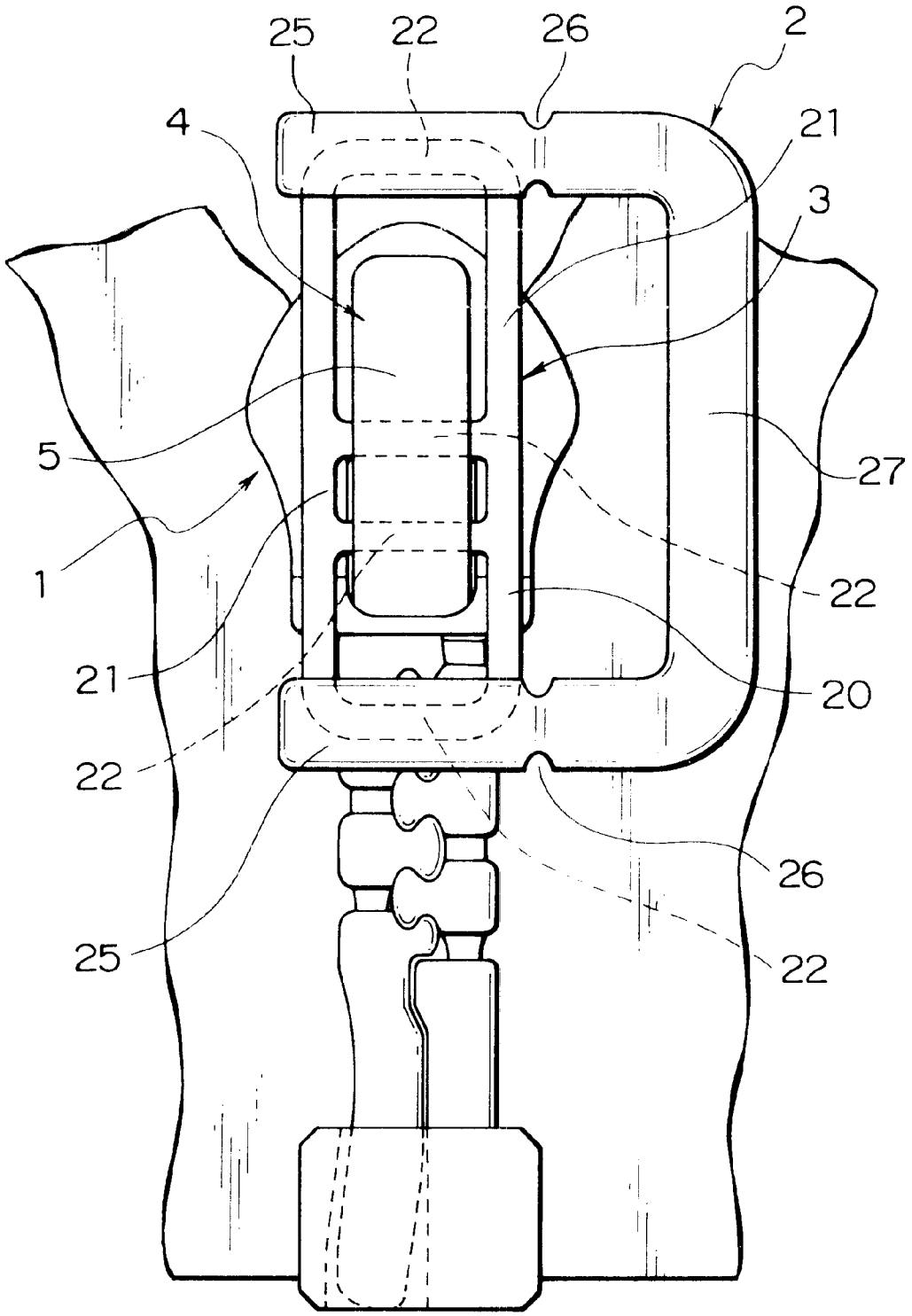
FIG. 6 is a plan view of a fastener chain having a zipper pull of a slider for slide fastener according to a third embodiment of the invention.

Next, a zipper pull of a slider according to a second embodiment shown in FIG. 5 will be described below. The connecting body 3 is of the same shape as the previous example and formed of a rectangular annular frame body 20 longer than the slider body 1. The frame body 20 is comprised of vertical bars 21 provided on both sides thereof and lateral bars 22 provided on front and rear ends while a lateral bar 22 is provided in the center of the frame body 20, so that the connecting body 3 is formed. Then, the zipper pull 2 formed of horizontally extended half-annular shaped resilient body is mounted to the lateral bars 22 at front and rear ends of this connecting body 3. A flat mounting piece 23 is provided on each of the lateral bars 22 so as to protrude and the mounting piece 23 is buried in the zipper pull 2 of resilient body so as to form a fixing portion 25.

As shown in the Figure, this connecting body 3 is provided on the slider with the automatic locking device. A sheet spring 17 is mounted on a top face of mounting posts 6 erected within the yoke 5 disposed on a top face of the slider body 1 and then, a locking pawl lever 10 having a locking pawl 11 protruded downward is disposed below the sheet spring 17. The lateral bar 22 disposed in the center of the connecting body 3 is inserted and installed between the slider body 1 and the locking pawl lever 10, such that the locking pawl 11 of the locking pawl lever 10 is protruded into the guide groove 9 through the pawl hole 8 and fitted in between the fastener elements, thereby automatically locking the slider.

In this type of the slider, when the grip portion 27 of the zipper pull 2 is lifted up slightly, the lateral bar 22 presses the sheet spring 17 disposed on the top face of the slider body 1 so that the leaf spring 17 is allowed to be lifted up. At the same time, the locking pawl lever 10 within the yoke 5 is allowed to rise, so that the slider can be slid either forward or backward.

A zipper pull of the slider according to a third embodiment shown in Fib. 6 will be described. A connecting body 3 is formed of a rectangular, annular frame body 20 longer than a slider body 1. The frame body 20 is comprised of vertical bars 21 provided on both sides thereof and lateral bars 22 disposed on front and rear ends while two lateral bars 22 are provided at some intervals in the center of the frame body 20 so as to form the connecting body 3. Then, a part of a zipper pull 2 formed of resilient body in the shape of the letter U is mounted integrally, that is, the lateral bars 22 are buried and fixed integrally in fixing portions 25 which are on edge portions of front and rear leg portions of the zipper pull 2. A main part of the zipper pull 2 which connects the leg portions composes a grip portion 27 which is substantially parallel to the slider body 1 of the zipper pull 2 and apart from the frame body 20. The grip portion 27 has an expanded diameter, and neck portions 26 are formed in the vicinity of the fixing portions 25.

Figure 7:
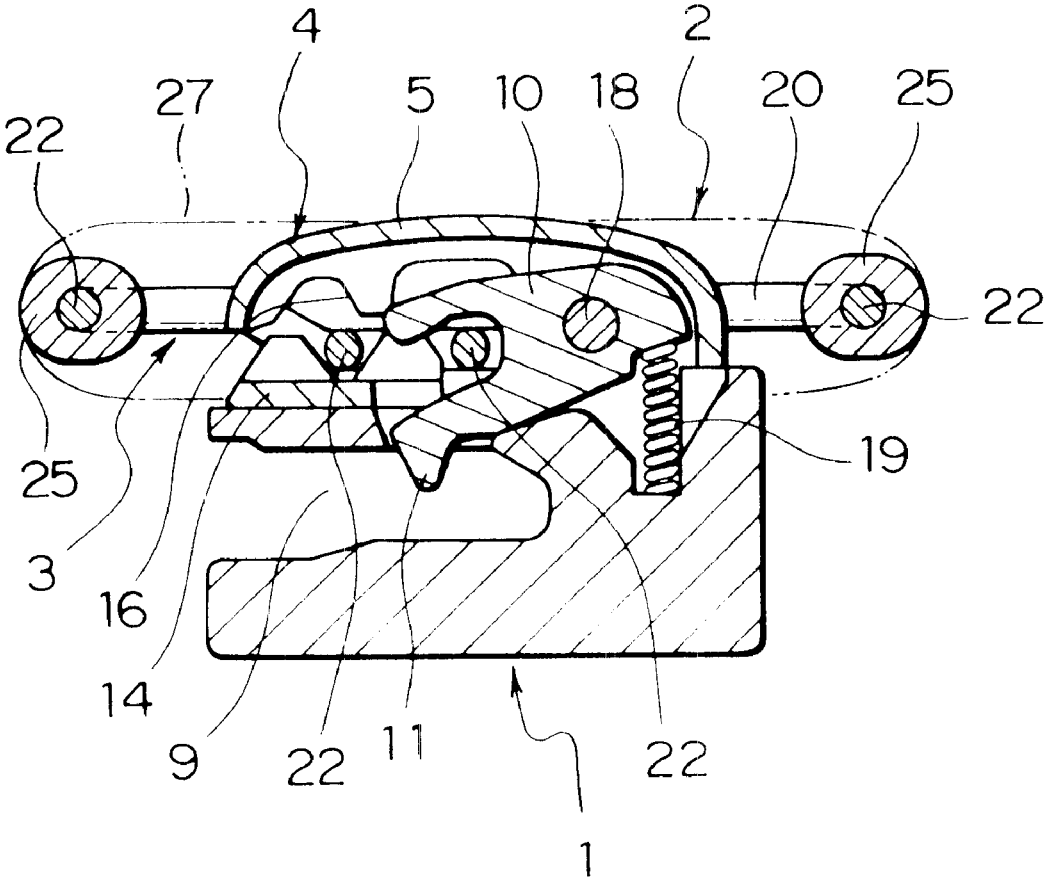
FIG. 7 is a longitudinal sectional view of the slider of FIG. 6.

This connecting body 3 is provided on the slider with automatic locking device as shown in FIG. 7 and a sliding body 14 which slides on the slider body 1 is comprised. A recess 16 formed by two mountains are formed on a top face of the sliding body 14 and a coil spring (not shown) is disposed between the sliding body 14 and an mounting post 6 in front thereof so that the sliding body 14 is allowed to slide in the case needed. A proximal portion of the locking pawl lever 10 is supported pivotally by the mounting post 6 with a supporting shaft 18. The locking pawl lever 10 includes a locking pawl 11 at a front end thereof and a concave portion 12 above the locking pawl 11. A coil spring 19 is disposed at a front end of the supporting shaft 18 so that the locking pawl 11 is always protruded into the guide groove 9 through a pawl hole 8.

Of the two lateral bars 22 provided in the center of the connecting body 3, the lateral bar 22 on the front end side is inserted through the concave portion 12 of the locking pawl lever 10 and the lateral bar 22 on the rear end side is inserted in the recesses 16 of the sliding body 14. When the connecting body 3 is installed on the slider body 1, the slider with automatic locking mechanism is assembled. When the grip portion 27 of the zipper pull 2 in the assembled slider is gripped and brought up, the two lateral bars 22 in the center of the connecting body 3 are raised slightly by the neck portions 26 and at the same time, the locking pawl lever 10 is also raised. Consequently, the locking pawl 11 is escaped from the guide groove 9 so that the slider can be slid freely.

Figure 8:
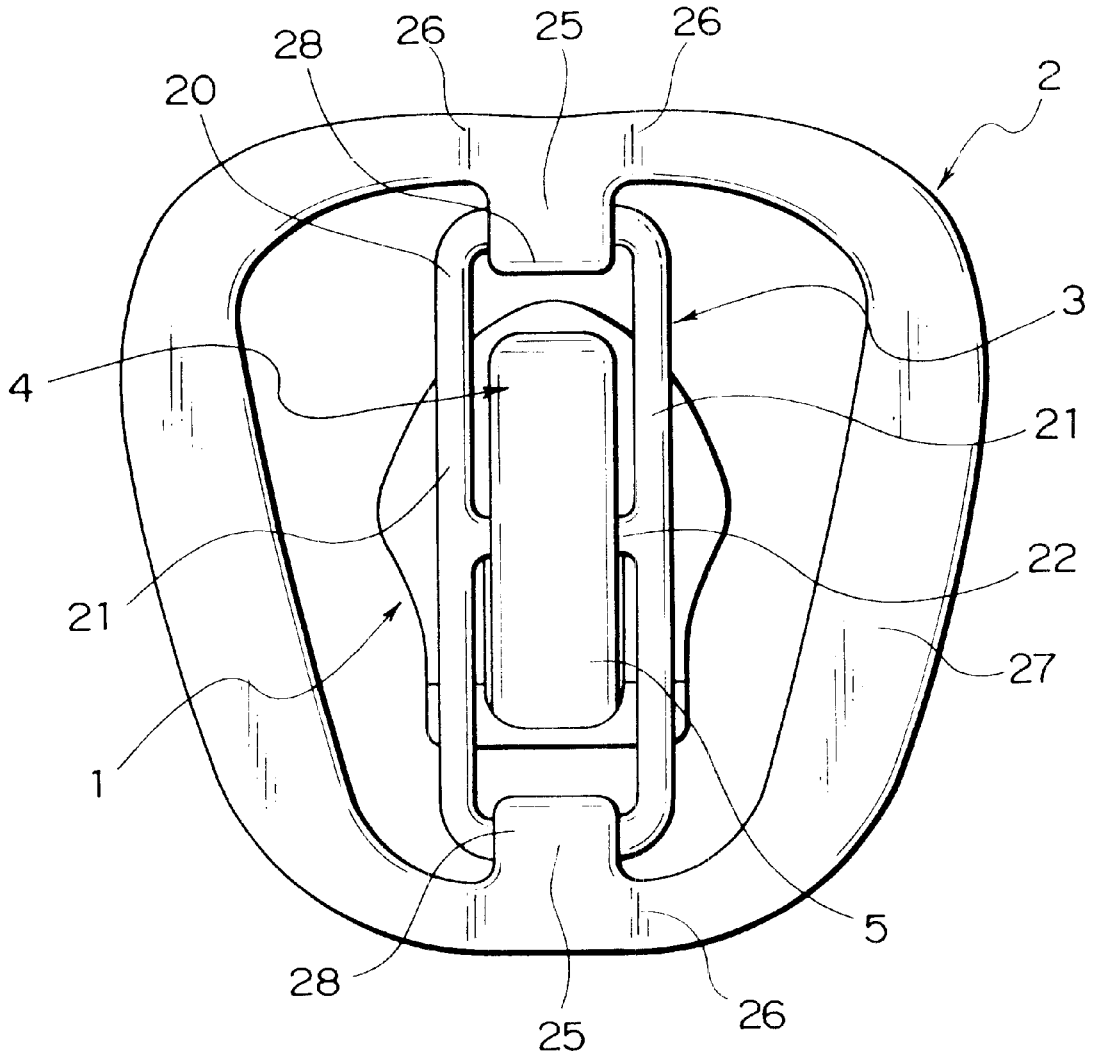
FIG. 8 is a plan view of a slider having a zipper pull of a slider for slide fastener according to a fourth embodiment of the invention.
Figure 9:
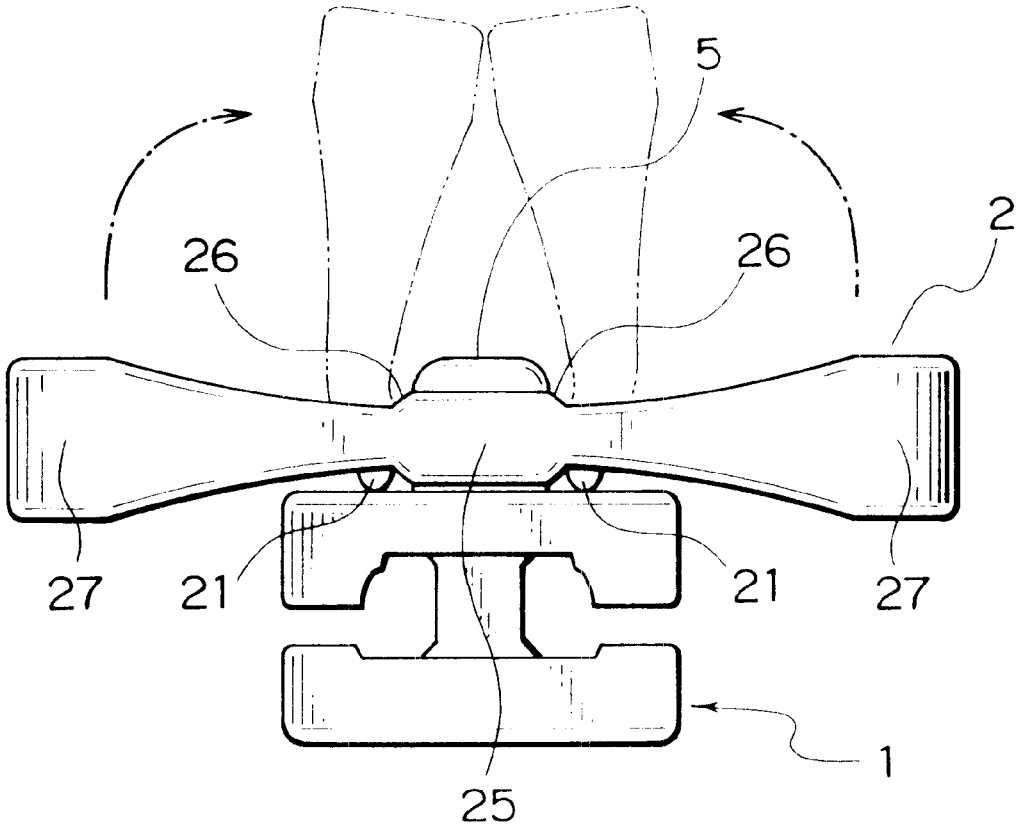
FIG. 9 is a rear view of the same slider of FIG. 8.

A zipper pull of the slider according to a fourth embodiment shown in FIGS. 8 and 9 will be described. A connecting body 3 is formed of a rectangular annular frame body 20 longer than the slider body 1. The frame body 20 is comprised of vertical bars 21 provided on both sides of the frame body 20 and lateral bars 22 provided on front and rear ends, while a lateral bar 22 is provided in the center of the frame body 20 so as to form the connecting body 3. A zipper pull 2 formed of resilient body in a substantially annular shape such that its front portion is expanded while its rear portion is narrowed is mounted to the lateral bars 22 on the front and rear ends of the connecting body 3. The zipper pull 2 which is mounted to the frame body 20 is provided with mounting tongues 28 each protruded inward toward an opposing one. Then, the lateral bars 22 at the front and rear ends are buried in this mounting tongue 28 so as to form fixing portions 25. A neck portion 26 is formed in the vicinity of the fixing portion 25 and a grip portion 27 having an enlarged diameter is formed at a position far from the fixing portions 25.

In case of this connecting body 3 also, like the previously described examples, the lateral bar 22 provided in the center of the frame body 20 is inserted into the locking pawl lever 10 of the slider provided with various types of automatic locking mechanisms, so as to assemble the slider with automatic locking device. The slider may be operated by lifting up both the grip portions 27 of the zipper pull 2 of resilient body, stretched to the right and left of the slider body 1 as shown in FIG. 9 or by bringing up any of the grip portions 27. Consequently, the connecting body 3 is raised slightly so that the locking pawl 11 is escaped from the guide groove 9, thereby making it possible to slide the slider freely.

Figure 10:
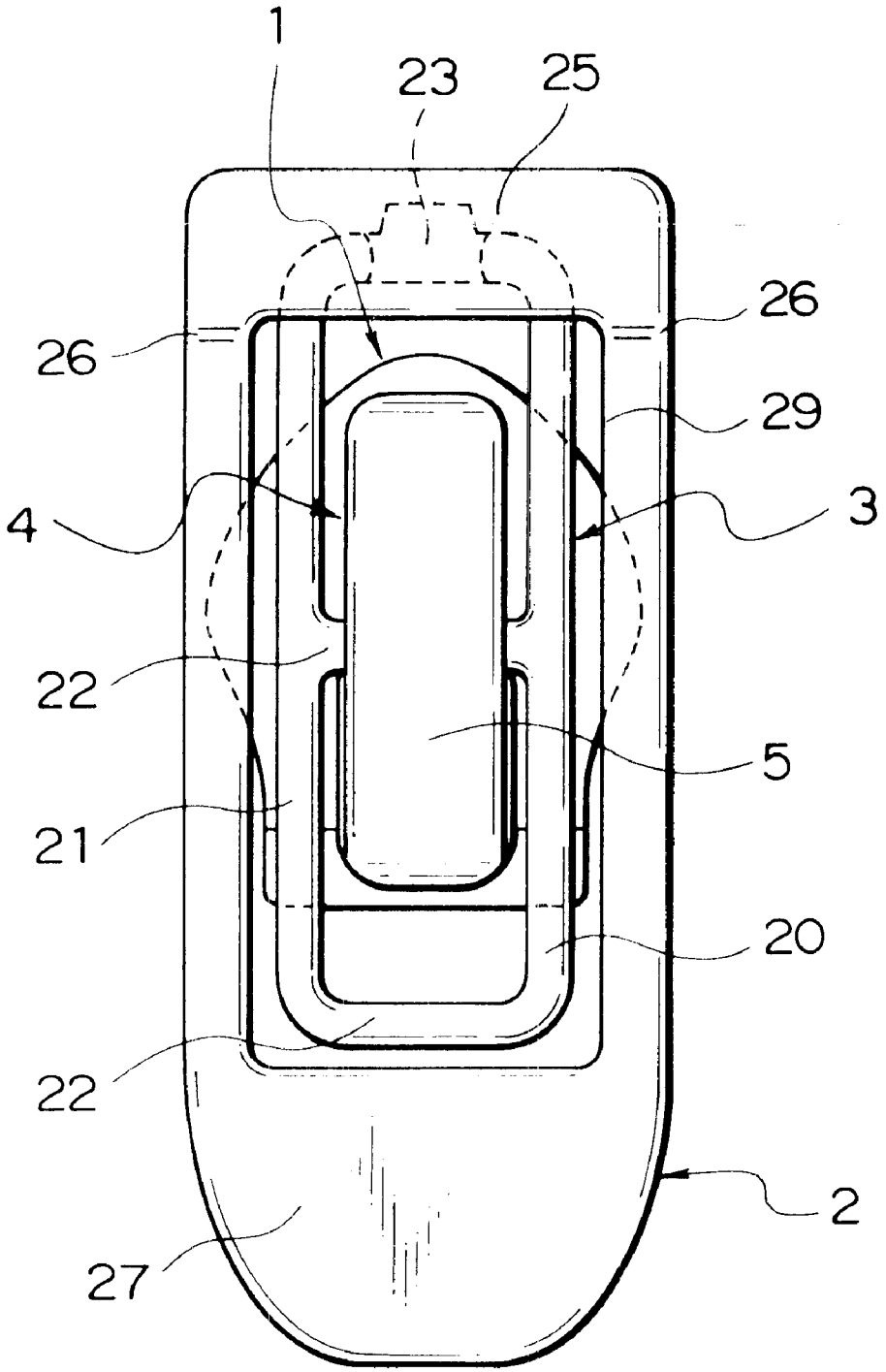
FIG. 10 is a plan view of a slider having a zipper pull of a slider for slide fastener according to a fifth embodiment of the invention.
Figure 11:
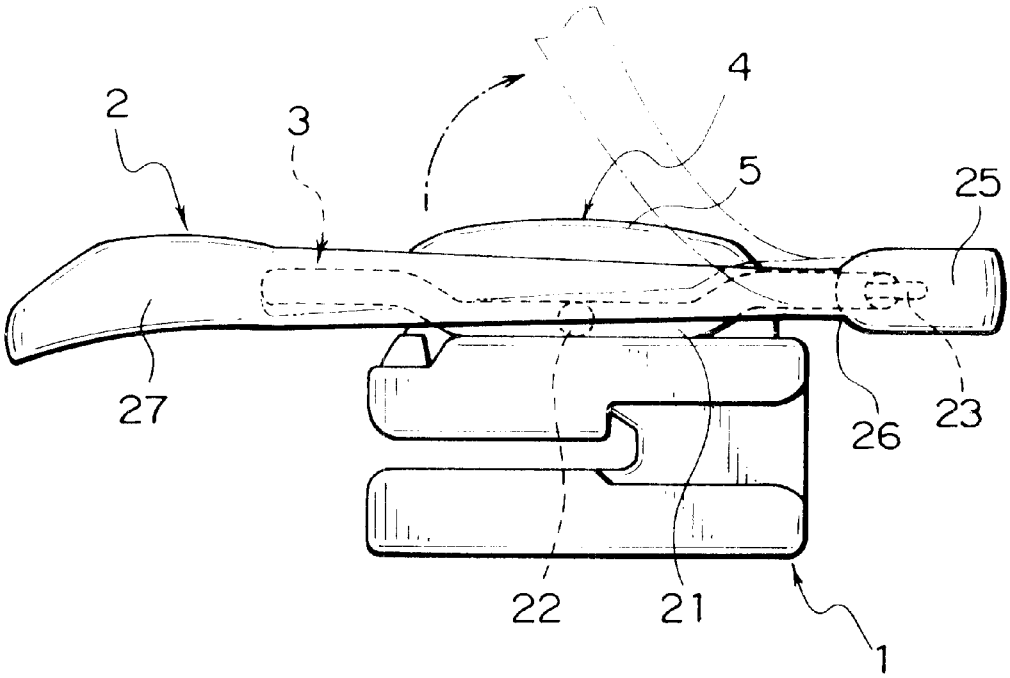
FIG. 11 is a side view of the slider of FIG. 10.

A zipper pull of a slider according to a fifth embodiment shown in FIGS. 10 and 11 will be described below. A connecting body 3 is formed of a rectangular, annular frame body 20 longer than the slider body 1. The frame body 20 is comprised of vertical bars 21 provided on both sides thereof and lateral bars 22 disposed on front and rear ends, while one lateral bar 22 is provided in the center of the frame body 20 so as to form the connecting body 3. The zipper pull 2 formed of resilient body in the form of a strip is mounted to the lateral bar 22 at the front end of this connecting body 3. A central portion of the zipper pull 2 is cut out to form a through hole 29 so that a zipper pull mounting portion 4 and part of the frame body 20 of the connecting body 3 appear. Because the zipper pull 2 having such a structure is placed on the surface of the slider body 1, it is fixed horizontally to the lateral bar 22. A flat mounting piece 23 is provided on the lateral bar 22 at the front end such that it protrudes outward so as to fix the zipper pull 2 of resilient body firmly. Neck portions 26 are formed in the vicinity of the fixing portion 25 formed on the zipper pull 2 and a grip portion 27 having a large thickness is formed at an end of the zipper pull 2.

In case of this connecting body 3 also, like the previously described examples, the lateral bar 20 provided in the center of the frame body 20 is inserted through the locking pawl lever 10 in the slider provided with various types of automatic locking mechanisms, so as to assemble the slider with automatic locking device. The slider is operated by lifting up the grip portion 27 of the zipper pull 2 mounted to the slider body 1 as shown in FIG. 11 so that the locking pawl 11 protruded into the guide groove 9 is escaped from the guide groove 9, thereby making it possible to operate the slider. Because the neck portions 26 are provided in the vicinity of the fixing portion 25, the zipper pull 2 can be bent flexibly so that the lateral bar 22 is raised slightly. Consequently, the slider having such a good appearance is finished that the zipper pull 2 is always fallen onto the surface of the slider body 1 and does not swing freely.

Figure 12:
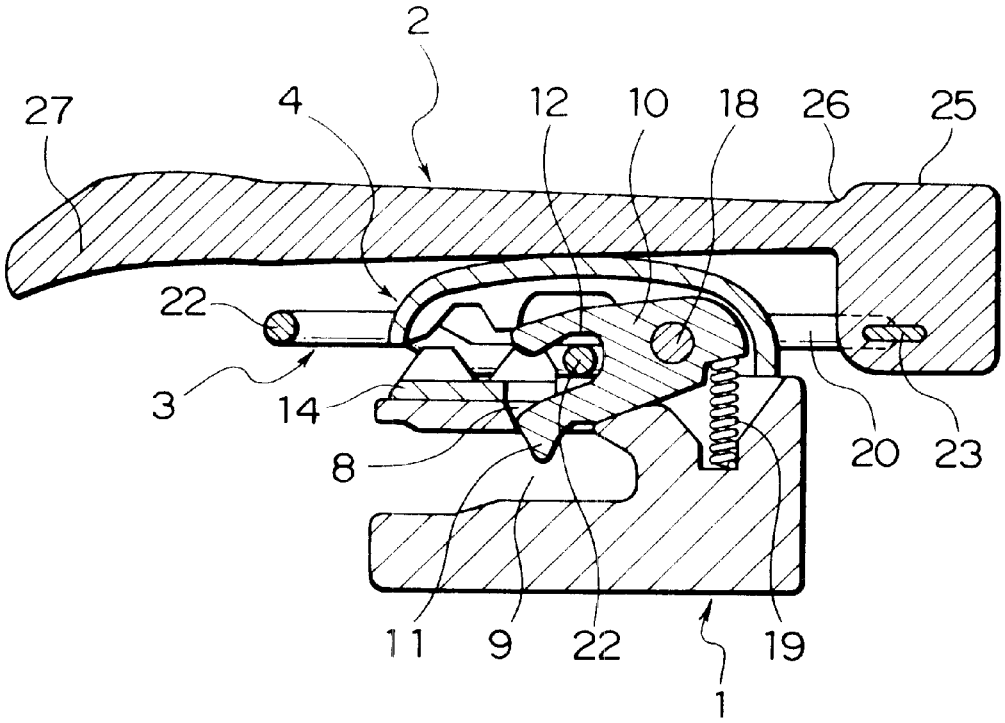
FIG. 12 is a longitudinal sectional view of a slider having a zipper pull of a slider for slide fastener according to a sixth embodiment of the invention.

Next, a zipper pull of a slider according to a sixth embodiment of the invention shown in FIG. 12 will be described. The connecting body 3 is of the same configuration as the fifth embodiment. The zipper pull 2 formed of resilient body is mounted to a lateral bar 22 at the front end of the frame body 20. The zipper pull 2 is fixed to a flat mounting piece 23 provided on the lateral bar 22 with a large thickness so as to form a thick fixing portion 25 and the sheet-like zipper pull 2 formed in a strip shape is extended from a top end of the thick fixing portion 25 such that it covers a yoke 5 which is a zipper pull mounting portion 4. As a result, this zipper pull 2 is capable of absorbing an impact from outside. The neck portion 26 is formed on a border between the fixing portion 25 and other portion of the zipper pull 2 and the grip portion 27 having a large thickness is formed at an end thereof.

By placing the lateral bar 22 provided in the center of the frame body 20 in a concave portion 12 of a locking pawl lever 10 of automatic locking mechanism, a slider having automatic locking device is assembled. It is permissible to form the frame body 20 in a small size such that the lateral bar 22 at the rear end of the frame body 20 is located in the vicinity of the slider body 1 so as to finish a small good-appearance slider. An operation of the zipper pull 2 is the same as the previously described examples.

Figure 13:
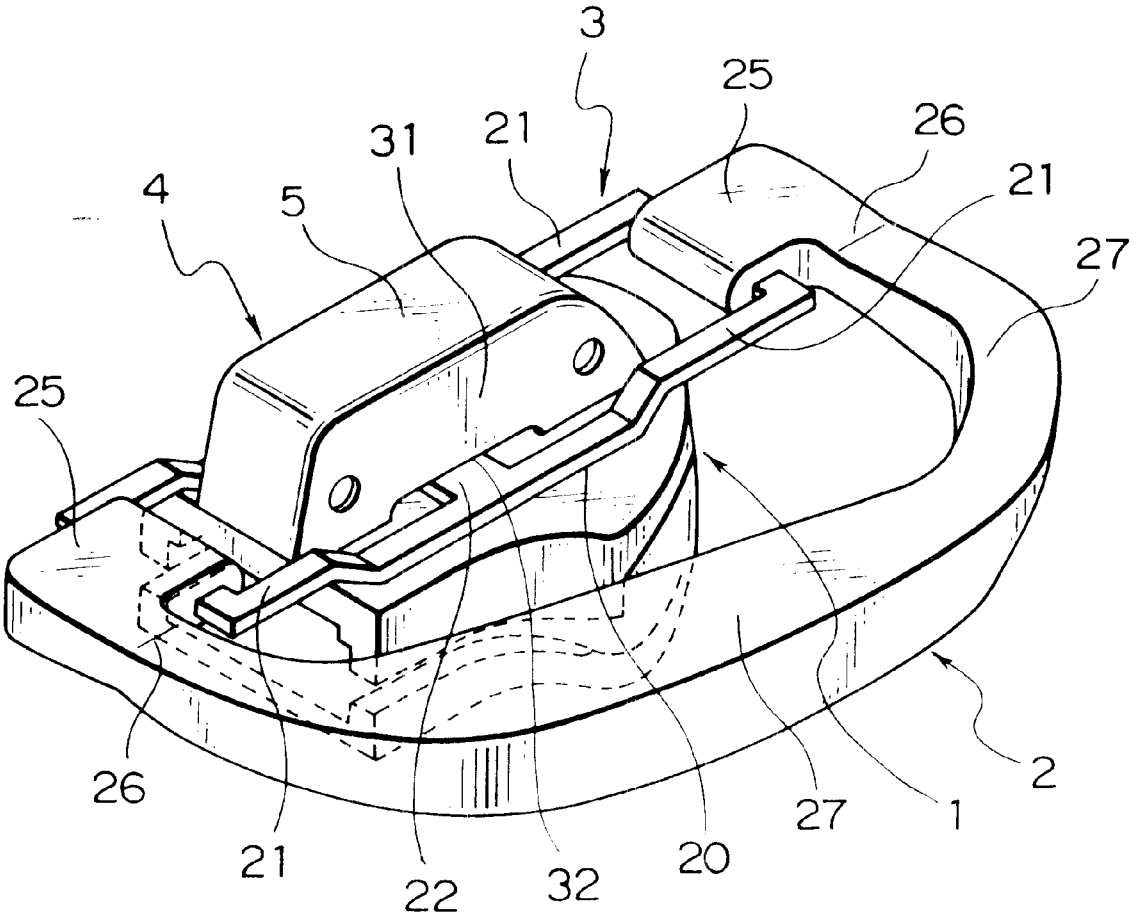
FIG. 13 is a perspective view of a slider having a zipper pull of a slider for slide fastener according to a seventh embodiment of the invention.
Figure 14:
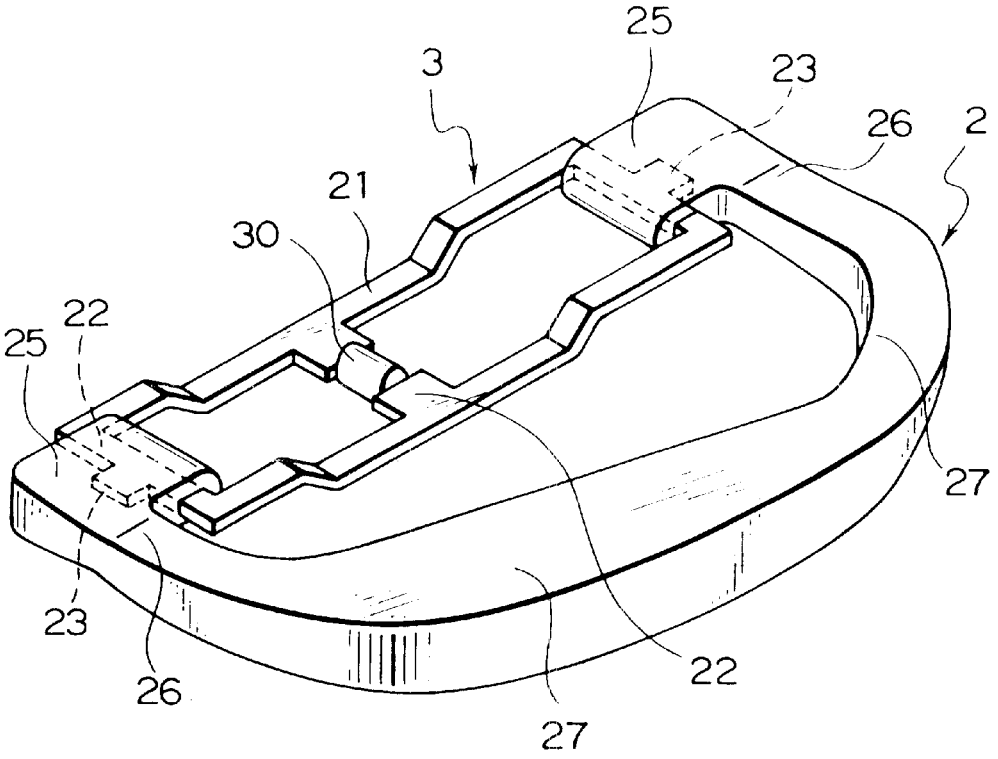
FIG. 14 is a perspective view showing a state in which a zipper pull is fixed to a connecting body of the slider of FIG. 13.
Figure 15:
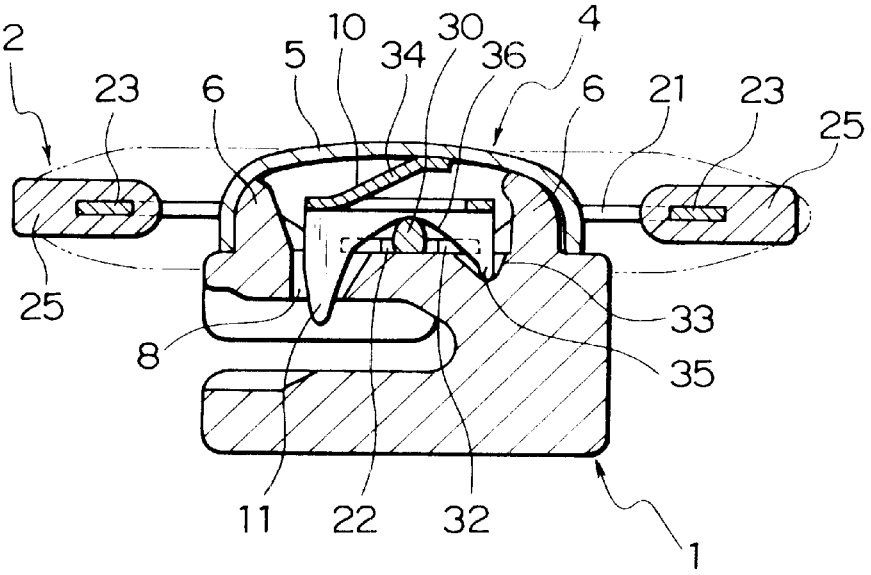
FIG. 15 is a longitudinal sectional view of the slider of FIG. 13.
Figure 16:
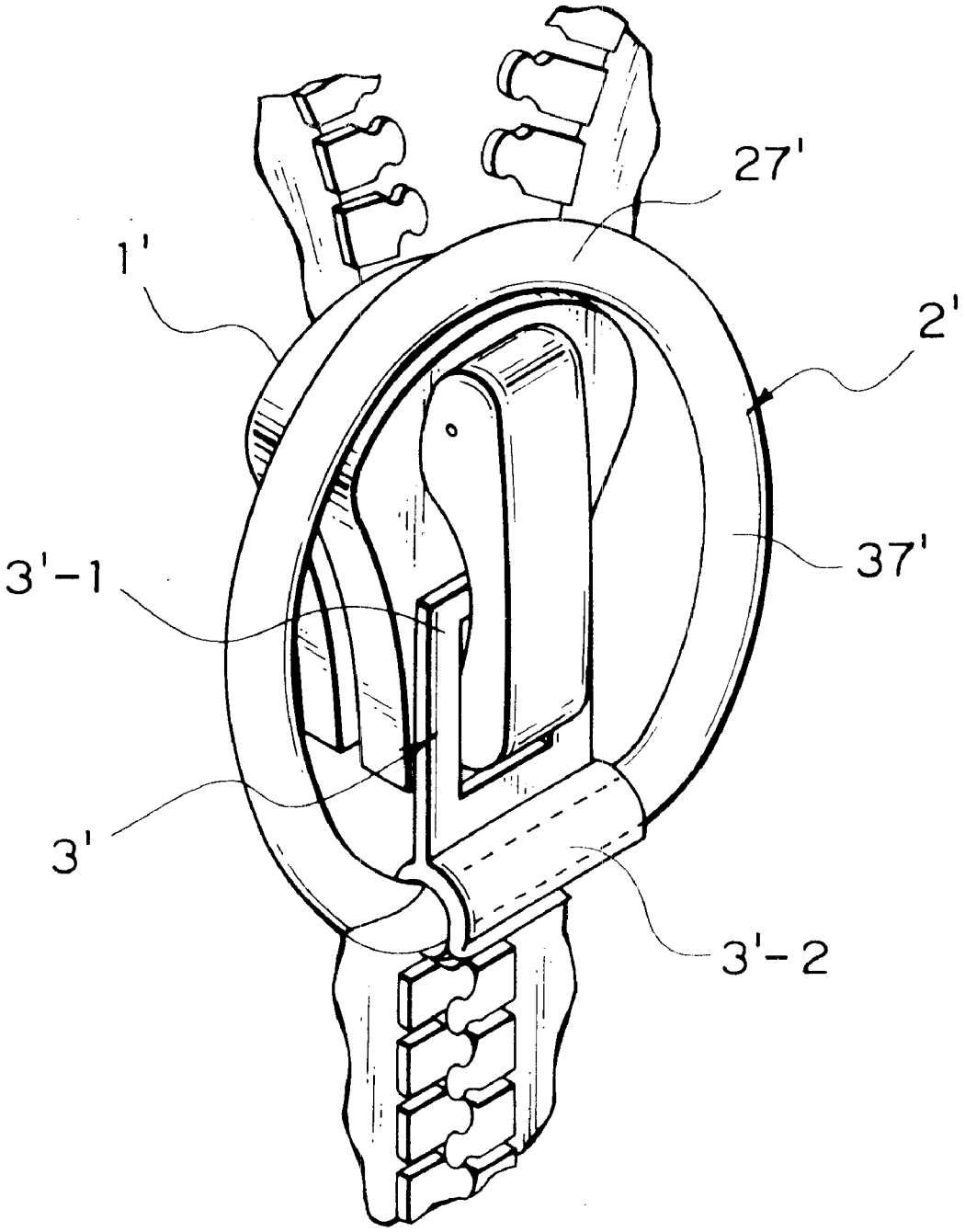
FIG. 16 PRIOR ART
FIG. 16 is a perspective view of a well known slider
Figure 17:
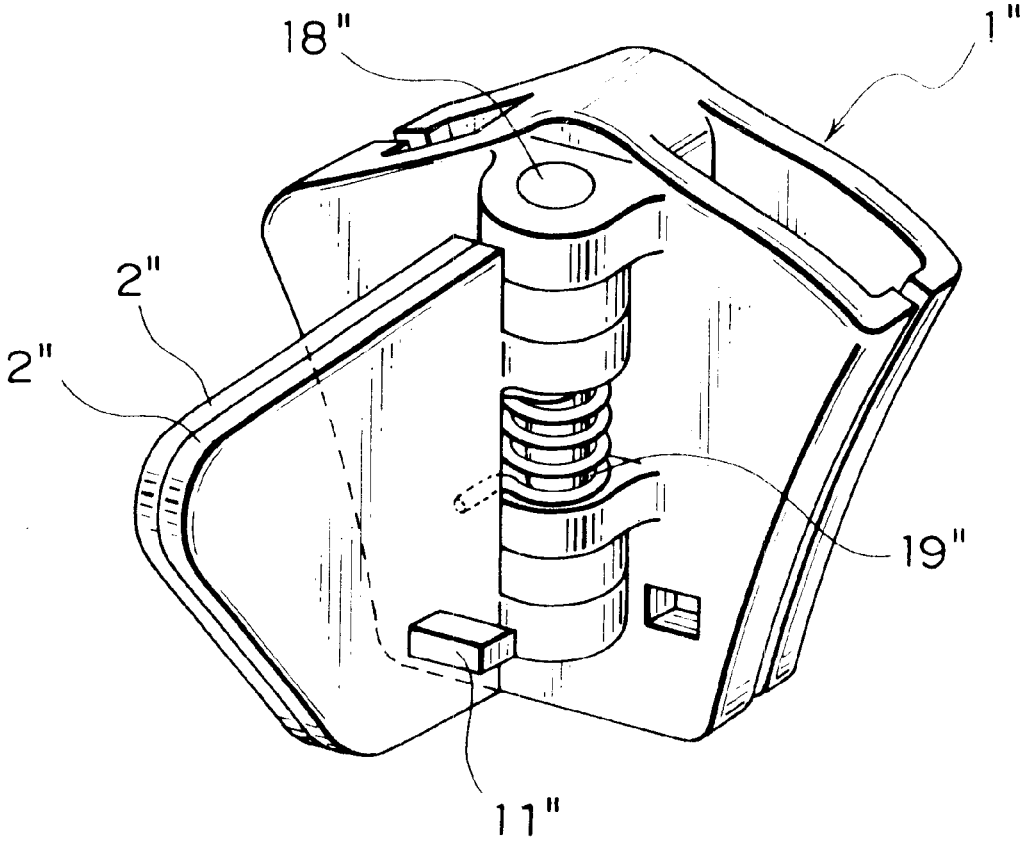
FIG. 17 PRIOR ART
FIG. 17 is a perspective view of another well known slider.

A zipper pull of a slider according to a seventh embodiment shown in FIGS. 13 to 15 will be described. A connecting body 3 is formed of a rectangular annular frame body 20 longer than the slider body 1. The frame body 20 is comprised of vertical bars 21 formed flat on both sides thereof and lateral bars 22 at front and rear ends and in the center thereof. An expanded head 30 is provided in the center of this central lateral bar 22 such that it protrudes upward. Mounting pieces 23 are provided on outer sides of the lateral bars 22 at the front and rear ends. Then, this frame body 20 is bent with a step such that a central portion thereof is low while both end portions are located higher and extended horizontally. Consequently, this frame body 20 can be placed on a top face of the slider body 1 in a stabilized condition.

The zipper pull 2 formed of resilient body is disposed on the lateral bars 22 at the front and rear ends of the connecting body 3 in a shape of ear. Mounting pieces 23 of the lateral bars 22 are buried in the zipper pull 2 so as to form a fixing portions 25. Neck portions 26 are formed in the vicinity of the both fixing portions 25 and a grip portion 27 having an expanded diameter or a large thickness is provided at a portion apart from the fixing portions 25 of the zipper pull 2. Further, the grip portion 27 is provided such that a space is expanded obliquely forward of the fixing portions 25 at the front end, so that the grip portion 27 is easy to grip.

On the other hand, the yoke 5 which is a zipper pull mounting portion 4 placed on a top face of the slider body 1 has a sliding opening 32 having a gap which allows the lateral bar 22 to slide longitudinally, the sliding opening 32 being provided on a lower end edge of each of both side walls 31. Mounting posts 6 for mounting the yoke 5 are provided on front and rear positions of the top face of the slider body 1. A recessed cut-out portion 33 is provided in a proximal portion of the front mounting post 6 so that a protruded portion 35 of an automatic locking pawl lever 10 is capable of being fitted therein with a gap. A pawl hole 8 is provided at a proximal portion of the rear attaching post 6 so that the locking pawl 11 is capable of inserting therein. The automatic locking pawl lever 10 is formed by bending a steel plate in an inclined U shape and a spring piece 34 is produced by cutting and erecting a top portion of the automatic locking pawl lever 10. Then, a locking pawl 11 is protruded at one of the bottom ends of the automatic locking pawl lever 10 so that it is capable of inserting in the pawl hole 8. A protruded portion 35 is provided at another one of the other bottom ends so that it is capable of being fitted in the concave portion 33 with a gap. Then, a mountain-like cut-out cam face 36 is provided between the locking pawl 11 and the protruded portion 35, so that an expanded head 30 of the lateral bar 22 can make contact with this cam face 36.

Upon assembly of the slider, first, the lateral bar 22 of the connecting body 3 is placed between the mounting posts 6 of the slider body 1 and the automatic locking pawl lever 10 is placed thereon. Then, the yoke 5 is placed over the mounting posts 6 and at the same time, the lateral bar 22 is disposed in the sliding opening 32. The yoke 5 is fixed to the mounting posts 6 by crimping so as to assemble the slider. If the grip portion 27 of the zipper pull 2 is gripped up and pulled after the slider is assembled, the zipper pull 2 is elastically deformed at the neck portions 26 and after that, the connecting body 3 slides along the sliding opening 32 so that the expanded head 30 of the lateral bar 22 acts on the cam face 36 of the automatic locking pawl lever 10. Consequently, the automatic locking pawl lever 10 is raised and the locking pawl 11 is also raised at the same time, so that the slider is capable of sliding freely.

Although the zipper pull of the slider of the present invention has been described with an example in which the lateral bar 22 provided on the frame body 20 of the connecting body 3 is mounted on the locking pawl lever 10 with automatic locking mechanism, the connecting body 3 having the zipper pull 2 formed of resilient body may be mounted to a free slider. In this case, a protruded mounting portion 4 through which the lateral bar 2 provided on the frame body 20 can be inserted may be formed on a top face of the slider body 1. Because the frame body 20 is disposed on the top face of the slider body 1, the zipper pull 2 formed of resilient body is always fallen onto the slider body 1 so that a good appearance free slider can be produced.

The zipper pull of the slider for slider fastener of the present invention has the above described structure. With such a structure, the following effects are exerted.

According to the invention, the zipper pull mounting portion 4 is provided on the top face of the slider body 1, the annular connecting body 3 having an appropriate shape is disposed in the longitudinal direction on the mounting portion 4, the lateral bar 22 is provided in the center of the connecting body 3, the lateral bar 22 is mounted on the mounting portion 4 such that it is inserted therethrough, the zipper pull formed of resilient body is fixed to the front and rear ends or the front end of the connecting body 3 so as to form the fixing portions 25 and the zipper pull 2 is always urged to be fallen on the surface of the slider body 1. When the zipper pull 2 of resilient body mounted on the slider body 1 is gripped and pulled in the direction perpendicular to the slider sliding direction or in the forward direction with a slight rotation amount, the slider can be slid easily. Further, upon operation, the twisting of the resilient body is so small that a damage due to the twisting is prevented, thereby ensuring a long term use. Further, the zipper pull 2 does not swing freely and is maintained on the slider body 1 in a stabilized condition with a good appearance. Thus, this zipper pull 2 is preferable for use in clothes.

Further, the zipper pull 2 made of resilient body is formed in the shape of half-annulus, full annulus, strip, or sheet and each zipper pull 2 produced above is fixed to the connecting body 3. Thus, the most suitable zipper pull 2 for various types of products using the slider or slide fastener can be supplied easily.

And further, the zipper pull 2 includes the constricted or concave neck portion 26 formed in the vicinity of the fixing portion 25 which fixes the zipper pull 2 formed of resilient body, a grip portion 27 provided such that a space is expanded obliquely forward with respect to the fixing portion 25, or a grip portion 27 having an enlarged diameter and a large thickness provided at a portion apart from the fixing portion 25. Consequently, when the slider is operated for sliding, the zipper pull 2 of resilient body can be elastically deformed easily or gripped easily. Therefore, this zipper pull 2 is easy to operate.

And further, the connecting body 3 for fixing the zipper pull 2 formed of resilient body is formed in a rectangular or elongated circle annular shape longer than the mounting portion 4, the connecting body 3 includes the lateral bars 22 provided such that a central portion disposed in the longitudinal direction of the slider body 1 on a top face of the slider body 1 is low while the front and rear ends thereof are located higher and extended horizontally with a step, and a flat mounting piece 23 extended inward or outward is provided on each of the lateral bars 22. As a result, the connecting body 3 in which the zipper pull 2 of resilient body is fixed can be disposed on the slider body with a good appearance in such a condition that it is easy to operate. Further, the connecting body 3 is held on the slider body 1 in a stabilized condition with a good appearance. And also, the lateral bar 22 can be buried easily so that the connecting body 3 is fixed to the zipper pull 2 firmly thereby ensuring a long term use.

Also, the lateral bar 22 provided in the center of the connecting body 3 is inserted through an automatic locking pawl lever 10 incorporated in a yoke 5, one of the lateral bars 22 provided in the center of the connecting body 3 is inserted through the automatic locking pawl lever 10 incorporated in the yoke 5 and the other one is inserted through a sliding body 14 capable of sliding within the yoke 5, the lateral bar 22 provided in the center of the connecting body 3 is fitted freely movably with an sliding opening 32 provided on bottom end of the yoke 5, and the automatic locking pawl lever 10 includes the spring piece 34 on the top portion, and the locking pawl 11 and protruded portion 35 on the bottom, so that the lateral bar 22 is in sliding contact with the cam face 36 formed between the locking pawl 11 and the protruded portion 35. Consequently, the connecting body 3 which fixes the zipper pull 2 of resilient body can be adapted easily to the slider having various types of the automatic locking mechanisms and the slider with the automatic locking device having a safe zipper pull 2 of good appearance can be produced easily.

And also, the zipper pull 2 of resilient body is formed of natural rubber, synthetic rubber or thermoplastic elastomer.

Therefore, various types of the zipper pulls 2 of resilient body can be produced easily from material elastically deformable and consequently, a highly efficient elasticity is secured. As described above, the effects which the invention exerts are very remarkable.

What is claimed is:

1. A slider for a slide fastener comprising a zipper pull mounting portion provided on a top face of a slider body of the slider; a connecting body disposed such that the connecting body traverses the top face of the slider body; at least one lateral bar provided in a center portion of the connecting body; said lateral bar being mounted on the mounting portion such that it is inserted therethrough; and a zipper pull formed of resilient body that is fixed to front and rear ends of the connecting body so as to form a plurality of fixing portions; wherein said zipper pull is always urged to be fallen on a surface of the slider body.

2. A slider for a slide fastener according to claim 1, wherein the zipper pull is formed in a substantially annular shape, wherein the connecting body includes lateral bars provided at both the front end and the rear end of the connecting body, wherein end portions of the zipper pull are fixed horizontally to the lateral bars provided at the front and rear ends of the connecting body so as to form the plurality of fixing portions.

3. A slider for a slide fastener according to claim 1, wherein the zipper pull is formed in a substantially annular shape, wherein the connecting body includes lateral bars provided at both the front end and the rear end of the connecting body; mounting tongues are provided at end portions of the substantially annular shaped zipper pull; and the mounting tongues are fixed horizontally to the lateral bars provided at the front and rear ends of the connecting body so as to form the plurality of fixing portions.

4. A slider for a slide fastener according to claim 1, wherein a neck portion is formed in the vicinity of the fixing portions where the zipper pull is fixed to the connecting body.

5. A slider for a slide fastener according to claim 1, wherein the zipper pull comprises a grip portion such that a space is expanded obliquely forward of the fixing portions where the zipper pull is fixed to the connecting body.

6. A slider for a slide fastener according to claim 1, wherein the zipper pull comprises a grip portion having an expanded diameter provided at a portion apart from the fixing portions where the zipper pull is fixed to the connecting body.

7. A slider for a slide fastener according to claim 1, wherein the connecting body for fixing the zipper pull is formed in a rectangular shape longer than the mounting portion and said connecting body is disposed longitudinally with respect to the mounting portion.

8. A slider for a slide fastener according to claim 1, wherein the connecting body for fixing the zipper pull comprises lateral bars such that the central portion of the connecting body, which is disposed longitudinally on the top face of the slider body, is low while the front end and the rear end of the connecting body are located higher and extend horizontally with a step.

9. A slider for a slide fastener according to claim 1, wherein a lateral bar is provided at the front end of the connecting body for fixing the zipper pull to form one of the plurality of fixing portions, wherein a flat mounting piece extending inward is provided on the lateral bar provided at the front end of the connecting body such that it protrudes from the lateral bar, and wherein said mounting piece is buried in the zipper pull.

10. A slider for a slide fastener according to claim 1, wherein the lateral bar provided in the center portion of the connecting body is inserted through an automatic locking pawl lever incorporated in a yoke mounted on the top face of the slider body such that the automatic locking pawl lever is capable of being raised.

11. A slider for a slide fastener according to claim 1, further comprising a second lateral bar provided in the center portion of the connecting body spaced by an interval with the at least one lateral bar provided in the center portion of the connecting body, wherein, of these two lateral bars provided in the center portion of the connecting body, one lateral bar is inserted through an automatic locking pawl lever incorporated in a yoke mounted on the top face of the slider body and the other lateral bar is inserted through a sliding body capable of sliding within the yoke such that the automatic locking pawl lever is capable of being raised.

12. A slider for a slide fastener according to claim 1, wherein the at least one lateral bar provided in the center portion of the connecting body is fitted freely movably in a sliding opening provided horizontally on a bottom end of each of both side walls of a yoke mounted on the slider body; the yoke incorporates an automatic locking pawl lever having a spring piece protruded on a top portion thereof, a locking pawl provided on a bottom end, a protruded portion capable of engaging freely detachably with a cut-out portion of the slider body and a cam face provided between the locking pawl and the protruded portion; and the at least one lateral bar provided in the center portion of the connecting body is kept in contact with the cam face so that the automatic locking pawl lever is capable of being raised.

13. A slider for a slide fastener according to claim 1, wherein the zipper pull of resilient body is formed of natural rubber, synthetic rubber or thermoplastic elastomer.

14. A slider for a slide fastener according to claim 1, wherein the zipper pull comprises a grip portion having a large thickness provided at a portion apart from the fixing portions where the zipper pull is fixed to the connecting body.

15. A slider for a slide fastener according to claim 1, wherein the connecting body for fixing the zipper pull is formed in an elongated circular shape longer than the mounting portion and said connecting body is disposed longitudinally with respect to the mounting portion.

16. A slider for a slide fastener according to claim 1, wherein a lateral bar is provided at the front end of the connecting body for fixing the zipper pull to form one of the plurality of fixing portions, wherein a flat mounting piece extending outward is provided on the lateral bar provided at the front end of the connecting body such that it protrudes from the lateral bar, and wherein said mounting piece is buried in the zipper pull.

* * * * *